US006295978B1

(12) United States Patent
Wark et al.

(10) Patent No.: US 6,295,978 B1
(45) **Date of Patent: *Oct. 2, 2001**

(54) METHOD FOR REDUCING DAMAGE TO WAFER CUTTING BLADES DURING WAFER DICING

(75) Inventors: James M. Wark; Salman Akram, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/619,944

(22) Filed: Jul. 20, 2000

Related U.S. Application Data

(63) Continuation of application No. 09/316,893, filed on May 21, 1999, now Pat. No. 6,112,740, which is a continuation of application No. 08/946,626, filed on Oct. 7, 1997, now Pat. No. 5,950,613, which is a division of application No. 08/755,832, filed on Nov. 26, 1996, now Pat. No. 5,809,987.

(51) Int. Cl.[7] ..... B28D 7/04
(52) U.S. Cl. ..... 125/35; 451/364
(58) Field of Search ..... 451/388, 390, 451/283, 285, 289, 290, 397, 402, 364, 28, 41, 54, 31, 57, 63, 44; 437/226, 227, 209, 212; 148/DIG. 28; 269/21; 125/35, 12, 13.01, 20

(56) References Cited

U.S. PATENT DOCUMENTS

| | | | |
|---|---|---|---|
| 3,004,766 | 10/1961 | Bryant . | |
| 3,690,780 | 9/1972 | Bjelland et al. . | |
| 3,809,050 | 5/1974 | Chough et al. . | |
| 3,811,182 | 5/1974 | Ryan, Jr. et al. . | |
| 3,976,288 | 8/1976 | Cuomo, Jr. . | |
| 4,138,304 | 2/1979 | Gantley . | |
| 4,521,995 | 6/1985 | Sekiya . | |
| 4,597,228 | 7/1986 | Koyama et al. . | |
| 4,625,463 | 12/1986 | Sekiya . | |
| 4,808,046 | 2/1989 | Pilkington et al. . | |
| 4,808,406 | 2/1989 | Brinkman . | |
| 5,029,418 | 7/1991 | Bull . | |
| 5,203,547 | 4/1993 | Marumo . | |
| 5,410,791 | 5/1995 | Wirth et al. . | |
| 5,445,559 | 8/1995 | Gale et al. . | |
| 5,451,549 | 9/1995 | Oki et al. . | |
| 5,527,744 | 6/1996 | Mignardi et al. . | |
| 5,605,489 | 2/1997 | Gale et al. . | |
| 5,809,987 | 9/1998 | Wark et al. . | |
| 6,067,977 | 5/2000 | Wark et al. . | |
| 6,112,740 * | 9/2000 | Wark et al. | 125/35 |

FOREIGN PATENT DOCUMENTS

| | | |
|---|---|---|
| 1230256 | 9/1960 | (FR) . |

* cited by examiner

*Primary Examiner*—Derris H. Banks
(74) *Attorney, Agent, or Firm*—Kirkpatrick & Lockhart LLP

(57) ABSTRACT

A method of forming a support for supporting the underside of a semiconductor wafer having a circuit side, an underside, and a street index that defines dice on the semiconductor wafer, at least during dicing of the semiconductor wafer, is provided. The method includes providing a support having a surface for supporting the underside of the semiconductor wafer and forming at least one recess in the surface corresponding to the street index of the semiconductor wafer.

20 Claims, 5 Drawing Sheets

METHOD FOR REDUCING DAMAGE TO WAFER CUTTING BLADES DURING WAFER DICING

This application is a continuation of U.S. patent application Ser. No. 09/316,893, filed on May 21, 1999 and now issued as U.S. Pat. No. 6,112,740, which is a continuation of patent application Ser. No. 08/946,626 filed Oct. 7, 1997 and now issued as U.S. Pat. No. 5,950,613, which is a division of patent application Ser. No. 08/755,832 filed Nov. 26, 1996, now issued as U.S. Pat. No. 5,809,987.

BACKGROUND OF THE INVENTION

1. Field of the Invention

The present invention is directed generally to a wafer cutting chuck used in conjunction with a wafer cutting blade for cutting a semiconductor wafer into dice and, more particularly, to a chuck which reduces wear and damage to a cutting blade, and an associated method.

2. Description of the Background

Integrated circuits have touched almost every aspect of society, such as children's games and toys, engine computers in automobiles, personal computers in homes and offices, and controllers in industrial processes. Better ways to fabricate integrated circuits are constantly being sought.

Integrated circuits are fabricated on semiconductor wafers, and the each wafer typically contains between 50 and 1,000 individual integrated circuits. Between the integrated circuits are spaces, known as "street indices", which separate the individual integrated circuits on the wafer. Street indices are as small as possible, and are typically 4 mil to 6 mil wide. In a process known as "dicing", wafers are cut along the street indices to form separate integrated circuits, known as "dice". A street index which has been cut is known as,a "street". When the dicing process is completed, the streets form a grid which defines the dice cut from the wafer.

The dicing process is performed with wafer spindle and blade assemblies having circular cutting blades. The design and use of wafer spindle and blade assemblies and cutting blades are well known in the prior art, and such devices may be obtained from Disco Hi Tech America, Inc., located in Santa Clara, Calif. The cutting blades are about one mil thick and spin at speeds between 30,000 and 60,000 revolutions per minute. Cutting blades are often nickel-plated with a diamond grit cutting edge to insure smooth, clean cuts, with minimal fraying and splintering.

Wafers are placed on a smooth, level surface, known as a "cutting chuck", where they are diced by a cutting blade. During the dicing process, a cutting blade will occasionally protrude below a wafer and into the underlying cutting chuck. The contact between the cutting blade and cutting chuck accelerates the wear on the cutting blade, and often breaks the cutting blade and results in damage to the cutting chuck.

It is well known in the prior art to use a wafer frame and adhesive tape to maintain dice in place during the dicing process. The wafer frame is generally flat and defines an opening which is larger than the wafer. The adhesive tape is attached to the wafer frame and stretched across the opening. A wafer is secured to the adhesive tape within the opening, and the frame is secured, for example by a vacuum, to the cutting chuck for dicing. After the dice have been cut, the frame, along with the adhesive tape and the dice, are removed from the cutting chuck. The dice are separated from the adhesive tape, the adhesive tape is removed from the frame, and the frame is reused. The adhesive tape is known as "sticky back" and is usually a polymer-based film, such as poly-vinyl chloride ("PVC"), with an adhesive coating on one side. The adhesive tape is usually about 3 mils thick. The dice stick to the adhesive, so that when the wafer is cut the dice remain in place on the cutting chuck and are not scattered. Because a cutting blade extends slightly below the wafer, the cutting blade is exposed to the adhesive tape. Unfortunately, the adhesive binds to the cutting blade, causing accelerated blade wear and "gumming-up" the cutting blade. The gumming-up of the cutting blade reduces the effectiveness of the blade, increases friction between the cutting blade and the wafer resulting in increased heat build up on the blade, and causes binding of the cutting blade, potentially breaking it. Those factors reduce the rate at which the cutting blade can be moved across a wafer, thereby increasing the amount of time required to dice a wafer.

Unfortunately, the accelerated wear and damage caused to cutting blades from impinging upon the chuck and exposure to the adhesive requires that they be replaced after dicing only about five or six wafers. Worn cutting blades lack the sharpness to cleanly cut a wafer, and cutting blades exposed to adhesives have rough sides and an irregular cutting surface formed from hardened adhesive picked up during previous cuts of a wafer. The continued use of a worn cutting blade may result in damaged or destroyed wafers caused by the cutting blade sailing catastrophically and spraying debris across the wafer. Replacing cutting blades is expensive, however, not only in terms of the costs of the cutting blade, but also in terms of down time of the dicing process and interruption of the fabrication process while an old cutting blade is being removed and a new cutting blade is being installed.

Thus, the need exists for an improved cutting chuck which reduces the amount of wear and damage to a cutting blade. In particular, the need exists for a cutting chuck which does not interfere with a cutting blade during dicing, and which reduces or prevents contact between a cutting blade and adhesives used to secure a wafer onto the cutting chuck.

SUMMARY OF THE INVENTION

The present invention is directed generally to a wafer cutting chuck used in conjunction with a wafer cutting blade for cutting a semiconductor wafer into dice. The chuck of the present invention reduces wear and damage to a cutting blade. The chuck has a surface for supporting a wafer. The chuck also has a plurality of recesses in its surface for accommodating a cutting blade of a wafer spindle and blade assembly. The recesses are at least as wide as the cutting blade and they correspond to street indices on the wafer.

Preferably, the chuck is constructed of a metal, a ceramic, or silicon. In a most preferred embodiment of the present invention, the recesses include ports which are connected to a vacuum pump. The ports allow a vacuum, created by the vacuum pump, to pull an adhesive tape from the wafer, so that the cutting blade of the wafer spindle and blade assembly does not contact the adhesive tape.

A spacer may also be used in conjunction with a wafer cutting blade and a conventional chuck for cutting a semiconductor wafer into dice. The spacer is located on the chuck and has a surface for supporting a wafer. The spacer also has a plurality of recesses in its surface for accommodating a cutting blade of a wafer spindle and blade assembly. The recesses are at least as wide as the cutting blade and they correspond to street indices on the wafer.

Preferably, the spacer is constructed of silicon. In a most preferred embodiment of the present invention, the recesses include ports which are connected to a vacuum pump. The ports allow a vacuum, created by the vacuum pump, to pull an adhesive tape from the wafer, so that the cutting blade of the wafer spindle and blade assembly does not contact the adhesive tape.

The present invention is also directed to a method of practicing the invention. The method includes applying an adhesive to a bottom side of the wafer, placing the wafer on the chuck, aligning the street indices on the wafer with the recesses in the chuck, and dicing the wafer along the street indices.

In a preferred method of practicing the invention, a step of applying a vacuum to the adhesive is performed prior to the dicing step. The vacuum is sufficient to displace adhesive tape from the wafer along the street indices of the wafer so that when the wafer is diced the cutting blade does not contact the adhesive tape. Following the dicing step, the vacuum is released and the adhesive tape resumes its original position.

The invention solves the above-mentioned shortcomings in the prior art by providing recesses in the chuck so that the cutting blade of the wafer spindle and blade assembly does not contact the chuck, thereby reducing wear on the cutting blade. Furthermore, the preferred embodiment of the invention prevents the cutting blade from contacting the adhesive tape, further reducing wear on the cutting blade.

BRIEF DESCRIPTION OF THE DRAWINGS

For the pre sent invention to be clearly understood and readily practiced, the present invention will be described in conjunction with the following figures, wherein.

DESCRIPTION OF THE PREFERRED EMBODIMENTS

It is to be understood that the Figures have been simplified and some elements have been drawn out of proportion to illustrate those aspects of a wafer dicing machine relevant for a clear understanding of the invention, while eliminating, for the purpose of clarity, many of the elements found in a typical wafer dicing machine. Those of ordinary skill in the art will recognize that other elements are required to produce an operational wafer dicing machine. However, because such elements are well known in the art, and because they do not further aid in the understanding of the present invention, a discussion of such elements is not provided herein.

Figure 1:
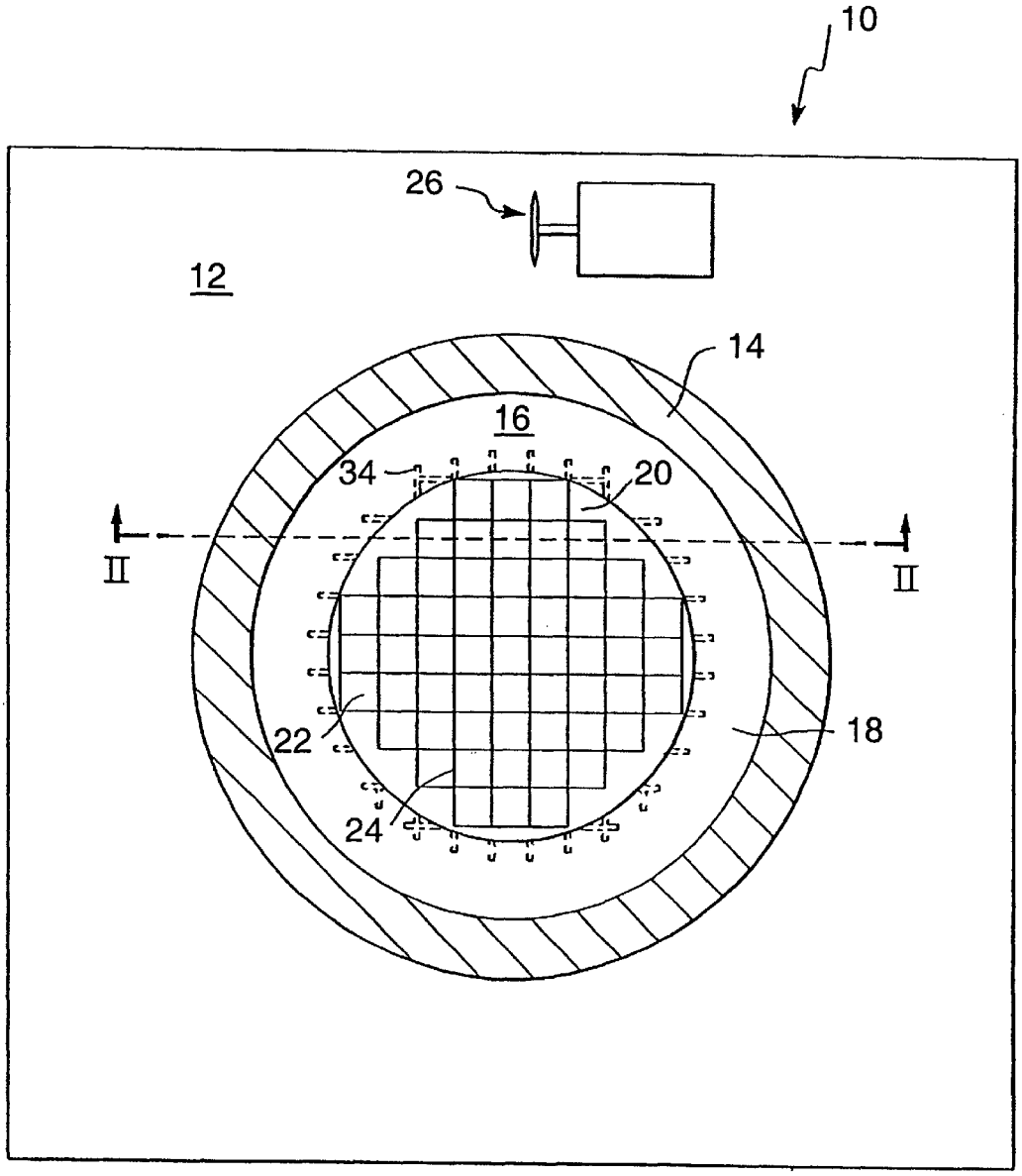
FIG. 1 is a top plan view of a wafer dicing machine constructed in accordance with the present invention.

FIG. 1 is a top plan view of a wafer dicing machine 10 constructed in accordance with the present invention. The machine 10 includes a chuck 12 on which a wafer frame 14 is secured. The wafer frame 14 has an opening 16, which is spanned by adhesive tape 18. The adhesive tape 18 secures a wafer 20 within the opening 16 of the frame 14. The wafer 20 includes a number of individual integrated circuits 22 separated by street indices 24. The street indices 24 form a pattern on the wafer 20 which defines the individual integrated circuits 22. Recesses 34, described below, are formed in the chuck 12 and correspond to the street indices 24 on the wafer 20. Preferably, the recesses 34 extend beyond the edge of the wafer 20. Also shown in FIG. 1 is a wafer spindle and blade assembly 26. The wafer spindle and blade assembly 26 is movable relative to the chuck 12 and is used to cut the wafer 20 along the street indices 24, so as to separate the individual integrated circuits 22 into dice, as is well known in the prior art. Although the wafer spindle and blade assembly 26 is described as moving relative to the chuck 12, the dicing machine 10 may also be operated with a wafer spindle and blade assembly 26 having a fixed position and with the chuck 12 being moved relative to the wafer spindle and blade assembly 26.

Figure 2:
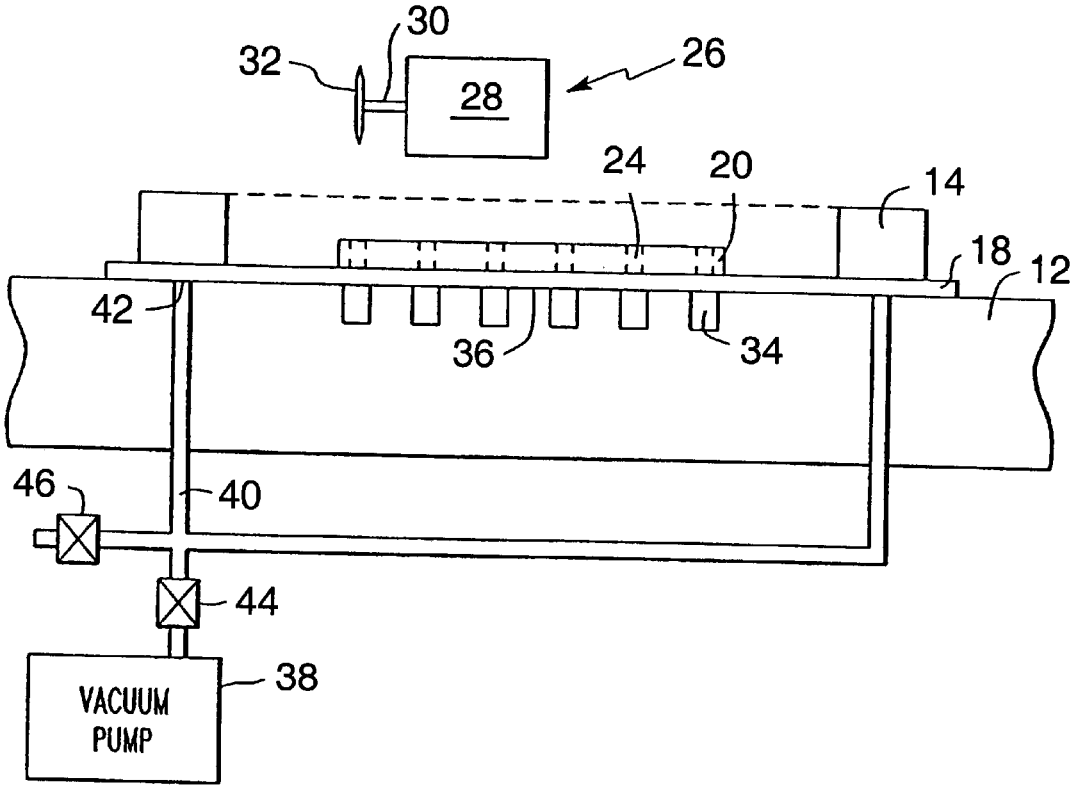
FIG. 2 is a cross-sectional view, taken along line II—II of FIG. 1, of a wafer dicing machine chuck constructed in accordance with the present invention.

FIG. 2 is a cross-sectional view of the wafer dicing machine 10 along lines II—II of FIG. 1. The wafer spindle and blade assembly 26 includes a motor 28, a shaft 30, and a cutting blade 32. The wafer 20 is fastened to adhesive tape 18 and the wafer 20 is supported on the top surface 36 of the chuck 12. The chuck 12 has a number of recesses 34 formed in its top surface 36, and there is one recess 34 corresponding to each street index 24 of the wafer 20. As a result, the number of recesses 34, and their spacing, will vary depending on the size of the wafer 20 being diced and the pattern of street indices 24. The recesses 34 are at least as wide as the cutting blade 32, and are at least as deep as the cutting blade 32 can be reasonably expected to protrude below the top surface of the chuck 12. Preferably, the recesses 34 are between approximately three and eight mils wide, and between approximately ten and fifty mils deep.

The recesses 34 in a chuck 12 may correspond to the street indices 24 of one size wafer 20 having one pattern of street indices 24, so that there is a one-to-one correspondence between the recesses 34 in the chuck 12 and the street indices 24 of the wafer 20. In that embodiment, a different chuck 12 is used for each different size of wafer 20 and each different street index 24 pattern. Alternatively, a chuck 12 may contain recesses 34 which correspond to several different street index 24 patterns, so that one chuck 12 may be used with several wafers 20 having different sizes and street index 24 patterns. In that embodiment, there is not a one-to-one correspondence between the recesses 34 in the chuck 12 and the street indices 24 of a wafer 20, because there are more recesses 34 in the chuck 12 than there are street indices 24 in any one wafer 20. As a result, when a wafer 20 is diced, not all of the recesses 34 are used. A chuck 12 having recesses 34 corresponding to several street index 24 patterns has the advantage of reducing the number of times that a chuck 12 needs to be changed when wafers 20 of varying sizes and street index 24 patterns are being diced.

The recesses 34 are preferably formed by either a cutting process or an etch process. Forming recesses 34 through a cutting process can be done simply and easily with a cutting device, such as a wafer spindle and blade assembly, by cutting the recesses 34 into the chuck 12. Forming the recesses 34 with an etch process can be done in several ways. Preferably, however, a nitride mask having openings where the recesses 34 are to be formed is deposited on the chuck 12. If the chuck 12 is made of silicon, a potassium hydroxide etch (KOH) is used to etch silicon at a rate of about 6–7 microns per hour at 52° C. The nitride mask can then be removed, leaving only the recesses 34.

The recesses 34 may be formed in many cross-sectional shapes. For example, recesses 34 may have cross-sectional shapes that are squared, "v"-shaped, semi-circular, semi-elliptical, and semi-trapezoidal, to suit the cutting blade 32 of the wafer spindle and blade assembly 26. When the recesses 34 are formed by a cutting process, the shape of a recess 34 is easily controlled by selecting an appropriately shaped blade. The shape of a recess 34 can be controlled in an etch process with the proper choice of isotropic and anisotropic etches, as is well known in the art of semiconductor etching.

The recesses 34 preferably extend approximately 0.250 inches beyond the edge of the wafer 20 in order to allow for the cutting blade 32 to completely cut a street in a wafer 20. The recesses 34, of course, may extend mostly or entirely across the chuck 12, so as to eliminate any risk of the cutting blade 32 hitting the end of a recess 34.

The chuck 12 is preferably formed from either metal, a ceramic, or silicon, although other materials may be used. Silicon is preferred because the etching of silicon is well understood, particularly by manufacturers of semiconductor products. On the other hand, metals, such as aluminum, can be easily machined to contain the desired number and shape of recesses. The use of ceramics, of course, will provide a very flat and very hard surface.

The wafer 20 is held in place and the dice are held together by adhesive tape 18. Preferably, the adhesive tape 18 is only sticky on the side adjacent to the wafer 20. The other side of the adhesive tape 18, the side adjacent to the chuck 12, is not sticky. The adhesive tape 18 is secured to the wafer frame 14 where its sticky side contacts the wafer frame 14. The wafer frame 14, in turn, is secured to the chuck 12 by a vacuum generated by a vacuum pump 38. Conduits 40 in and around the chuck 12 channel the vacuum from the vacuum pump 38, through the chuck 12, and to vacuum openings 42 on the top surface of the chuck 12. The vacuum openings 42 correspond with the location of the wafer frame 14 in order to hold the wafer frame 14 against the chuck 12. The vacuum openings 42 are shown holding the wafer frame 14 by engaging the adhesive tape 18, which is fastened to the wafer frame 14. Alternatively, however, the wafer frame 14 may be held by the vacuum openings 42 directly by providing holes in the adhesive tape 18, or by the adhesive tape 18 stopping short of the vacuum openings 42. The number of vacuum openings 42 may vary, as is known in the prior art. For example, a plurality of closely-spaced openings 42 may be provided. Alternatively, one or a small number of elongated openings 42 may exist on the top surface of the chuck 12 for engagement of the wafer frame 14. In addition, a control valve 44 is preferably provided between the vacuum pump 38 and the vacuum openings 42 to connect and disconnect the vacuum pump 38 with the vacuum openings 42. Alternatively, the control valve 44 may be omitted and the vacuum pump 38 may simply be turned on 20 and off when needed. A pressure release valve 46 may also be provided to release the vacuum within the conduit 40 and allow the frame 14 to be removed. As an alternative to the pressure release valve 46, the vacuum pump 38 may be run in reverse to repressurize the vacuum openings 42.

The recesses 34 in the chuck 12 allow the wafer 20 to be diced without any risk of the cutting blade 32 contacting the chuck 12. As a result, the chuck 12 shown in FIG. 2 substantially reduces wear on the cutting blade 32, thereby extending the cutting blade's 32 useful life.

According to the invention illustrated in FIG. 2 and above, a method of dicing a wafer 20 is also disclosed. An adhesive, such as a one-sided adhesive tape 18, is applied to a wafer 20. The wafer 20 is placed on a chuck 12 with the non-sticky side of the adhesive tape 18 adjacent to the surface 36 of the chuck 12. The street indices 24 of the wafer 20 are aligned with the recesses 34 of the chuck 12. Finally, the wafer 20 is diced along the street indices 24. When the wafer 20 is diced the cutting blade 32 does not contact the chuck 12 because the recesses 34 correspond to the street indices 24, and the subsequent streets 51, of the wafer 20.

Figure 3:
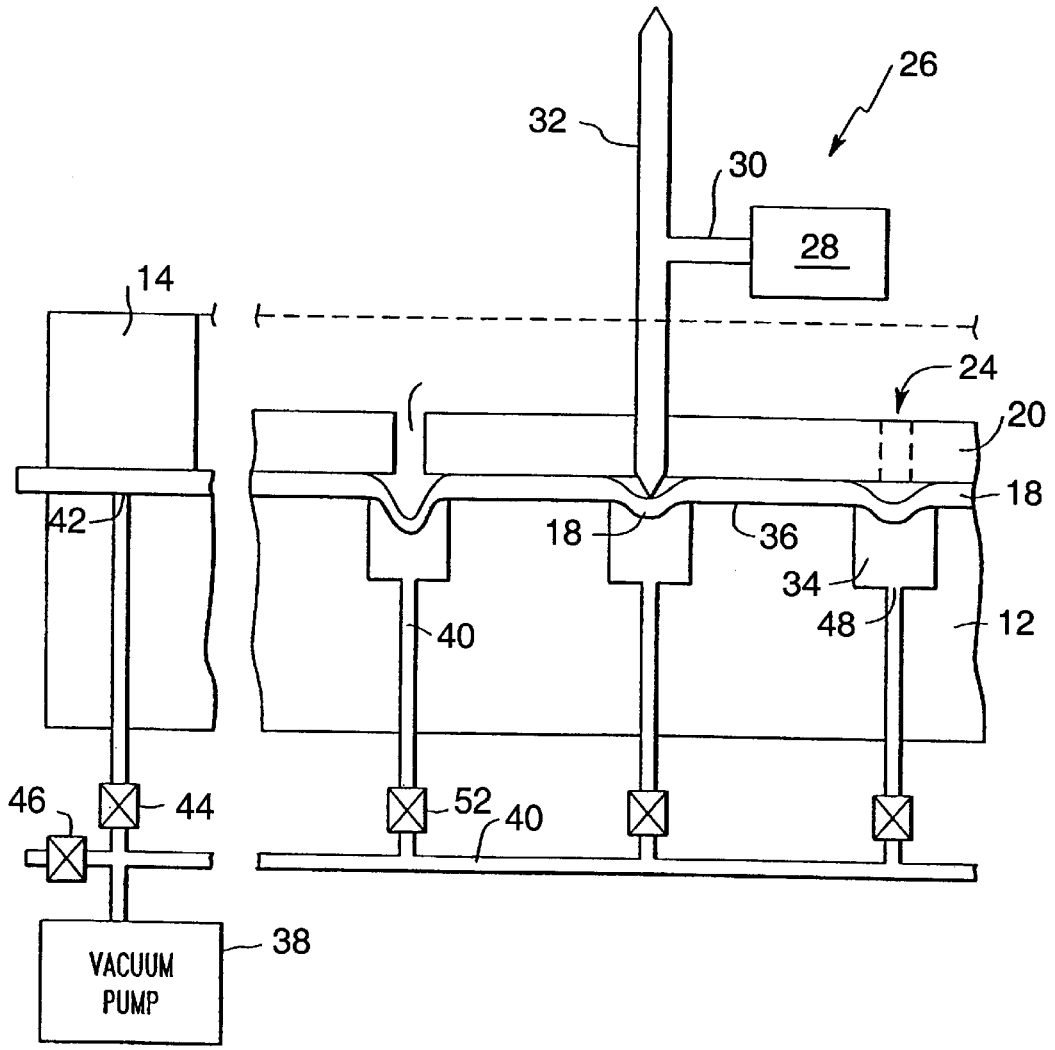
FIG. 3 is a cross-sectional view of a wafer dicing machine in operation and constructed in accordance with the present invention.

FIG. 3 is a cross-sectional view of a wafer dicing machine 10 in operation. The machine 10 includes a chuck 12 constructed according to a most preferred embodiment of the invention. A wafer 20 is secured to adhesive tape 18, and both the wafer 20 and the adhesive tape 18 are located on a top surface 36 of the chuck 12 with a wafer frame 14. A plurality of recesses 34 are located in the chuck 12 and correspond with street indices 24 on the wafer 20. A vacuum pump 38 is connected to each of the recesses 34 via conduits 40 in and around the chuck 12 and ports 48 in the recesses 34. The ports 48 are evenly spaced and exist throughout the recesses 34 to form a generally uniform vacuum throughout. Each port 48 preferably is a three to eight mil opening in the recess 34, and each opening is spaced approximately 0.5 inches apart. Elongated openings, different sized openings, and different spacing of the openings are also contemplated.

Figure 4:
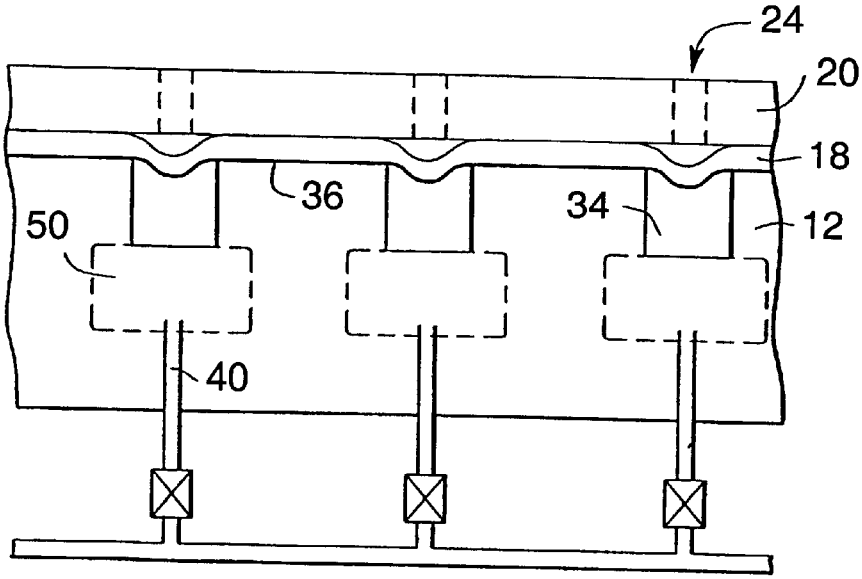
FIG. 4 is a cross-sectional view of a portion of an alternative embodiment of a chuck constructed in accordance with the present invention.

As shown in FIG. 4, a port may also be formed by a porous material 50, such as a porous ceramic, adjacent to the recess 34. In that embodiment, the conduit 40 terminates short of the recess 34 and a vacuum is formed in the recess 34 via the porous material 50.

Referring back to FIG. 3, the vacuum pump 38 creates a pressure drop within the recesses 34 beneath the adhesive tape 18, causing the adhesive tape 18 to be pulled away from the wafer 20. When the adhesive tape 18 is pulled away from the wafer 20, it is out of the way of the cutting blade 32. As a result, the problems caused to cutting blades 32 by adhesive tape 18, such as wearing on the cutting blade, gumming up of the cutting blade, binding up of the cutting blade, and breakage of the cutting blade, are eliminated. A pressure drop between approximately eighteen and twenty inches of mercury relative to the ambient pressure is usually sufficient to pull the adhesive tape 18 from the wafer 20. A valve 52, such as a solenoid-controlled valve, may be used to connect and disconnect a recess 34 to the vacuum pump 38. One valve is preferably provided for each recess 34, or portion of the recess 34, so that the use of the vacuum can be confined to the recess 34, or portion of the recess 34, through which the cutting blade 32 is currently passing. When the dicing process has finished, pressure is returned to the recesses 34, allowing the adhesive tape 18 to regain its original shape against the street 51 cut in the wafer 20.

According to the invention illustrated in FIG. 3 and described above, a method of dicing a wafer 20 is also disclosed. An adhesive, such as a one-sided adhesive tape 18, is applied to a wafer 20. The wafer 20 is placed on a chuck 12 with the non-sticky side of the adhesive tape 18 adjacent to the surface 36 of the chuck 12. The street indices 24 on the wafer 20 are aligned with the recesses 34 in the chuck 12. A vacuum is applied to the adhesive tape 18 to pull the adhesive tape 18 from the wafer 20. The wafer 20 is diced along the street indices 24. Finally, when the dicing is finished, the vacuum is removed from the recess 34, such as through a pressure release valve 46, and the adhesive tape 18 returns to its original shape against the wafer 20. Since the wafer 20 is diced while the adhesive tape 18 is pulled from the wafer 20, the cutting blade 32 does not contact the adhesive tape 18.

Figure 5:
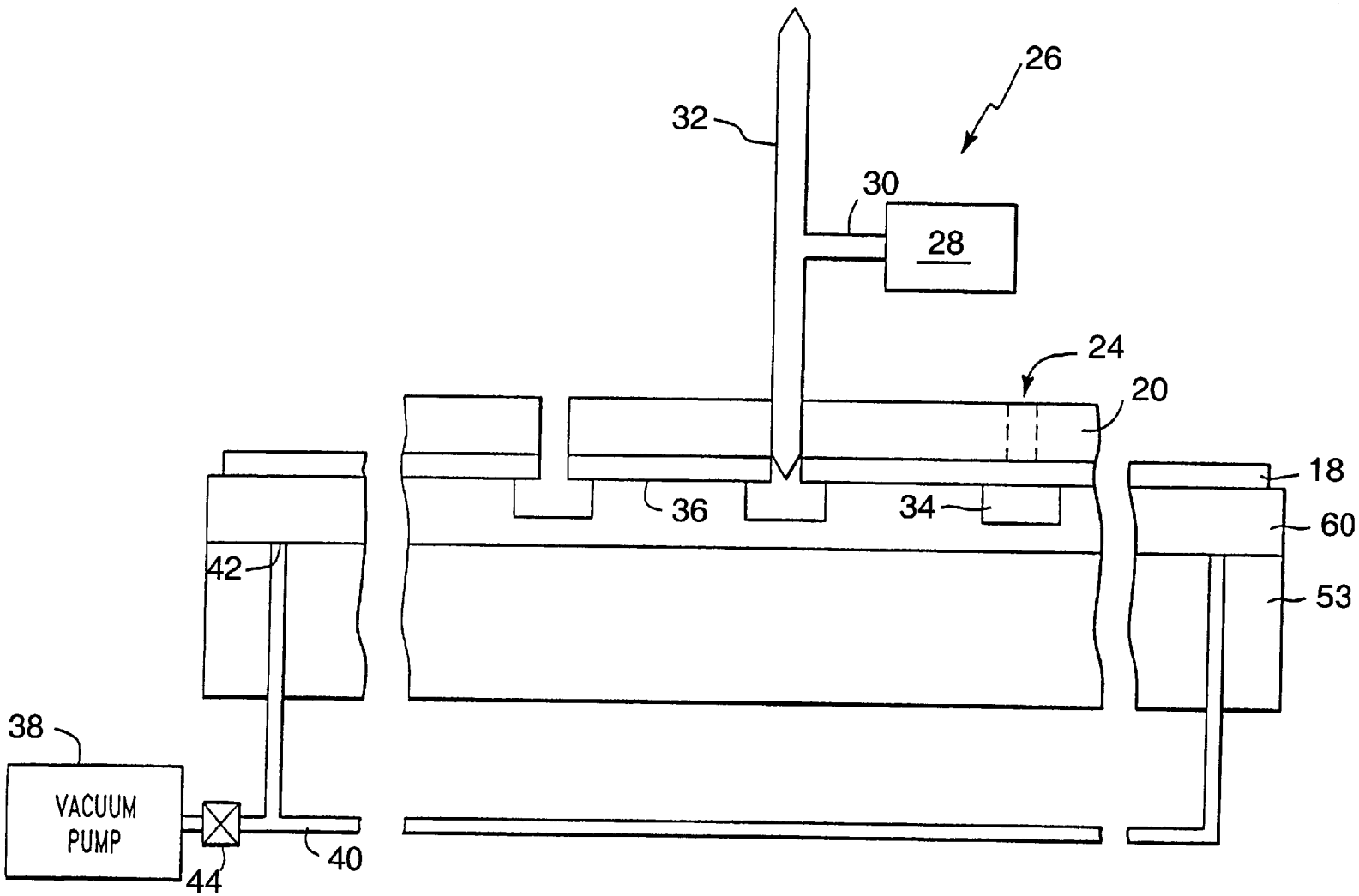
FIG. 5 is a cross-sectional view of a portion of an alternative embodiment of a wafer dicing machine constructed in accordance with the present invention.

The present invention may be easily modified for use with existing wafer dicing machines 10. FIG. 5 shows a cross-sectional view of an alternative embodiment of the invention adapted for use with a conventional wafer dicing machine. The alternative embodiment may be constructed of the same materials and in the same manner as the chuck 12 described above, with the exception of the differences described below. The conventional machine includes a conventional chuck 53 which is fitted to the machine. A spacer 60, embodying the invention and containing recesses 34 corresponding to the street indices 24 on a particular wafer to be diced, is secured to the conventional chuck 53. The spacer 60 is held in place, for example, by a vacuum provided to vacuum openings 42 by a vacuum pump 38 and conduits 40 normally used to secure a wafer frame 14. A wafer 20 may be secured to the spacer 60 in a number of ways. For example, double-sided adhesive tape 18 may be applied to the spacer 60, and the wafer 20 applied to the double-sided adhesive tape 18. Alternatively, an adhesive, without a carrying medium such as tape, may be applied directly to either the wafer 20 or the spacer 60, and used to secure the wafer 20 to the spacer 60.

The spacer 60 may be constructed in the same manner as the chuck 12 described above with respect to FIGS. 1–4. For example, the spacer 60 may be made from metal, ceramic, silicon, plastic, or a plastic-like material, such as a liquid crystal polymer, and the recesses 34 may be formed with a cutting process or an etching process. Preferably, the spacer 60 is constructed of silicon and the recesses 34 are formed by a cutting process. The spacer 60 is preferably a silicon wafer, for example a wafer which has been damaged or is in some way unsuitable for forming integrated circuits thereon. Such pieces of silicon are abundant in semiconductor processing facilities. The thickness of the spacer 60 is preferably between eighteen mils and twenty-nine mils, although almost any thickness greater than fifteen mils is generally suitable.

After the wafer spindle and blade assembly 26 has cut the wafer 20 into dice, the dice may be removed from the spacer 60 while the spacer 60 is being held in place by the vacuum. Alternatively, the spacer 60 and the dice may be removed from the conventional chuck 53, and the dice and the spacer 60 separated by mechanical means or with the use of a chemical solvent. By providing a spacer 60 embodying the invention and secured to a conventional chuck 53 via a vacuum, a conventional wafer dicing machine can realize the benefits of the present invention without modification. The embodiment illustrated in FIG. 5 eliminates damage to the cutting blade 32 caused by impingement of the cutting blade 32 on the chuck 53 or the spacer 60.

Figure 6:
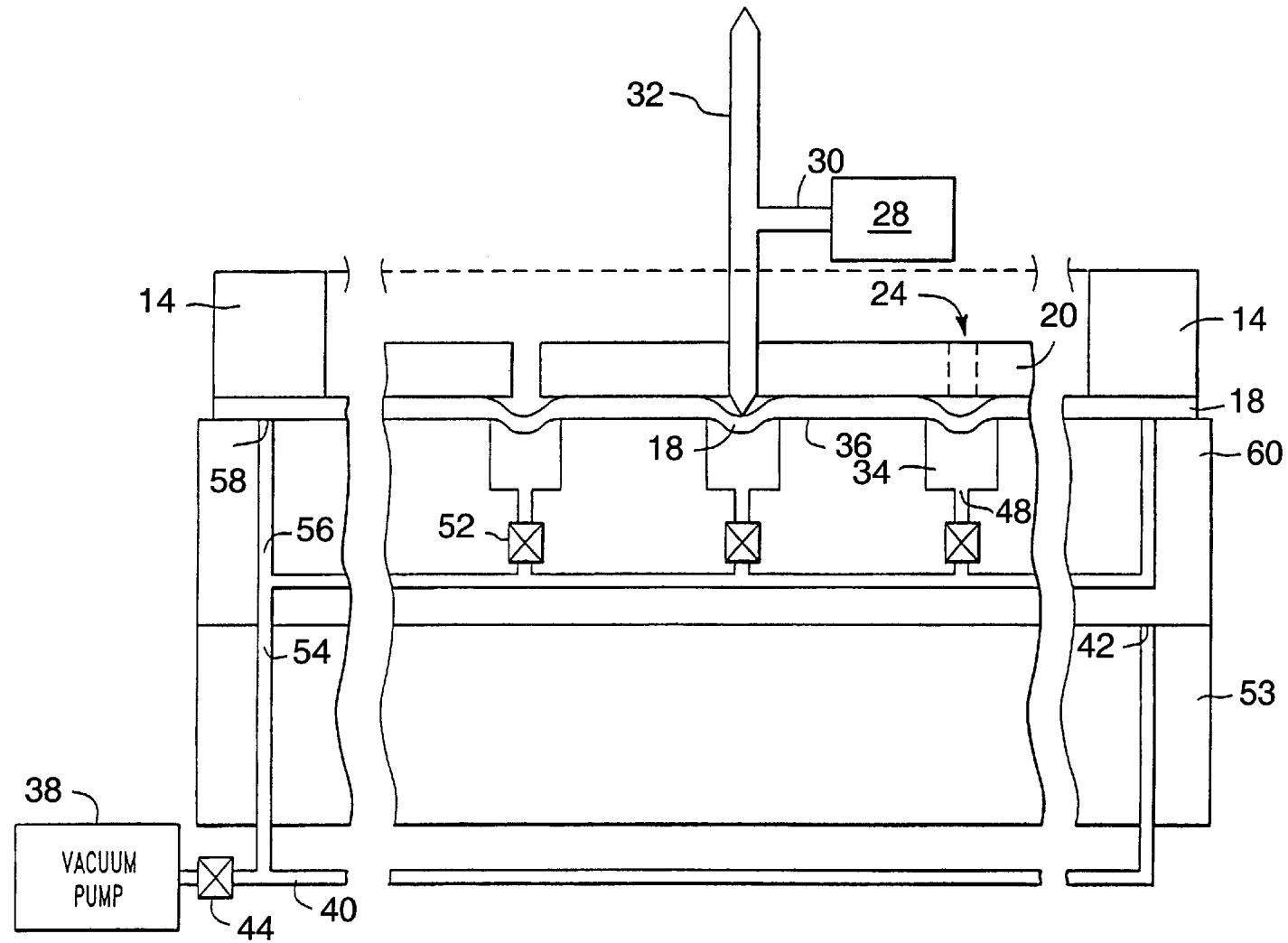
FIG. 6 is a cross-sectional view of a portion of an alternative embodiment of a wafer dicing machine constructed in accordance with the present invention.

FIG. 6 shows a cross-sectional view of an alternative embodiment of the invention shown in FIG. 5. The alternative embodiment illustrated in FIG. 6 may be constructed of the same materials and in the same manner as embodiments described above, with the exception of the differences described below. The embodiment illustrated in FIG. 6 is more complex and has more advantages than the embodiment illustrated in FIG. 5. As in the embodiment illustrated in FIG. 5, recesses 34 in a spacer 60 correspond to the street indices 24 on a wafer 20 to be diced. In FIG. 6, some of the vacuum openings 42 in the conventional chuck 52 are used to secure the conventional chuck 53 and the spacer 60 together. Other vacuum openings 54 in the conventional chuck 53, however, connect with vacuum conduits 56 in the spacer 60 which are used to secure a wafer frame 14 to the spacer 60 via vacuum openings 58. Furthermore, the conduits 56 provide a vacuum within recesses 34 in the spacer 60 via ports 48. As a result, one-sided adhesive tape 18 may be used to secure the wafer 20 to the frame 14, and the vacuum in the recesses 34 will separate the adhesive tape 18 from the wafer 20. As discussed above, the vacuum to the recesses 34 may be controlled individually with valves 52 to connect and disconnect the recesses 34 to the vacuum pump 38. The spacer 60 is preferably between approximately 0.25 inches and 0.5 inches thick, although almost any thickness greater than 100 mils is generally suitable. The embodiment illustrated in FIG. 6 eliminates damage to the cutting blade 32 caused by impingement of the cutting blade 32 on either the chuck 53 or the spacer 60, as well as impingement of the cutting blade 32 on adhesive tape 18.

Those with ordinary skill in the art will recognize that many modifications and variations of the present invention may be implemented. The foregoing description and the following claims are intended to cover all such modifications and variations.

What is claimed is:

1. A method of forming a support for a semiconductor wafer at least during dicing of the semiconductor wafer, wherein the semiconductor wafer has a circuit side, an underside, and a street index that defines dice on the semiconductor wafer, comprising:

providing a support having a surface for supporting the underside of the semiconductor wafer; and forming at least one recess in the surface corresponding to the street index of the semiconductor wafer.

2. The method of claim 1, wherein the support has an endless edge and said forming includes forming at least one recess extending from a first portion of the endless edge to a second portion of the endless edge.

3. The method of claim 1, wherein said forming includes forming at least one recess having a width at least as wide as a cutting blade utilized for dicing the wafer.

4. The method of claim 1, further comprising placing an adhesive intermediate the support and the semiconductor wafer.

5. The method of claim 4, further comprising displacing the adhesive from the wafer at the at least one recess.

6. The method of claim 5, wherein said displacing includes applying a negative pressure intermediate the adhesive and the support.

7. The method of claim 5, further comprising forming a port through the support in fluid communication with the recess.

8. The method of claim 7, further comprising applying a negative pressure to the port.

9. The method of claim 1, wherein said forming includes cutting the support.

10. The method of claim 1, wherein said forming includes etching the support.

11. The method of claim 1, wherein said forming includes forming a recess having a V-shaped cross-section.

12. The method of claim 1, wherein said forming includes forming a recess having a semi-circular cross-section.

13. The method of claim 1, wherein said forming includes forming a recess having a semi-elliptical cross-section.

14. The method of claim 1, wherein said forming includes forming a recess having a semi-trapezoidal cross-section.

15. The method of claim 1, further comprising forming at least one second recess on the support.

16. The method of claim 15, further comprising aligning a street index of a second semiconductor wafer with the at least one second recess.

17. The method of claim 1, further comprising forming at least one port in fluid communication with the surface of the support.

18. The method of claim 17, further comprising applying a negative pressure to the port for securing the underside of the semiconductor wafer to the support.

19. The method of claim 17, further comprising:

securing the semiconductor wafer to a wafer frame; and applying a negative pressure to the port to secure the wafer frame to the support.

20. A method of forming a support for supporting the underside of a semiconductor wafer during dicing of the semiconductor wafer, wherein the semiconductor wafer has a circuit side, an underside, and a street index that defines dice on the semiconductor wafer, comprising:

providing a support having a surface for supporting the underside of the semiconductor wafer;

forming a plurality of recesses, having a width at least as wide as a cutting blade utilized for dicing the wafer, in the surface, wherein the recesses correspond to the street index of the semiconductor wafer;

placing an adhesive intermediate the support and the semiconductor wafer;

forming a port through the support in fluid communication with the recess; and applying a negative pressure to the port.

* * * * *

UNITED STATES PATENT AND TRADEMARK OFFICE

CERTIFICATE OF CORRECTION

PATENT NO. : 6,295,978 B1
DATED : October 2, 2001
INVENTOR(S) : Wark et al.

It is certified that error appears in the above-identified patent and that said Letters Patent is hereby corrected as shown below:

Column 3,
Line 31, delete "pre sent" and insert -- present -- therein.

Column 5,
Line 60, delete "20" after "on".

Signed and Sealed this

Twenty-first Day of May, 2002

*Attest:*

*Attesting Officer*

JAMES E. ROGAN
*Director of the United States Patent and Trademark Office*